US009503806B2

(12) United States Patent
Crosswell et al.

(10) Patent No.: US 9,503,806 B2
(45) Date of Patent: Nov. 22, 2016

(54) LOUDSPEAKER SYSTEM AUDIO RECOVERY IMAGING AMPLIFIER

(71) Applicants: Joseph B Crosswell, Boone, NC (US); William J Godwin, Deep Gap, NC (US)

(72) Inventors: Joseph B Crosswell, Boone, NC (US); William J Godwin, Deep Gap, NC (US)

( * ) Notice: Subject to any disclaimer, the term of this patent is extended or adjusted under 35 U.S.C. 154(b) by 0 days.

(21) Appl. No.: 14/956,794

(22) Filed: Dec. 2, 2015

(65) Prior Publication Data

US 2016/0088386 A1 Mar. 24, 2016

Related U.S. Application Data

(63) Continuation-in-part of application No. 13/430,926, filed on Mar. 27, 2012, now abandoned.

(51) Int. Cl.

*H04R 1/28* (2006.01)
*H04R 1/02* (2006.01)
*H04R 1/22* (2006.01)

(52) U.S. Cl.

CPC ..... *H04R 1/2834* (2013.01); *H04R 1/025* (2013.01); *H04R 1/2826* (2013.01); *H04R 1/2842* (2013.01); *H04R 1/2869* (2013.01); *H04R 1/227* (2013.01); *H04R 2201/405* (2013.01)

(58) Field of Classification Search

CPC H04R 1/2834; H04R 1/2842; H04R 1/2826; H04R 1/2869; H04R 1/025; H04R 1/227; H04R 2201/405

See application file for complete search history.

(56) References Cited

U.S. PATENT DOCUMENTS 4,016,953 A 4/1977 Butler
4,064,966 A 12/1977 Burton
4,268,719 A 5/1981 Manger
4,301,332 A 11/1981 Dusanek
4,466,505 A 8/1984 Ritter
4,805,221 A 2/1989 Quaas
4,882,760 A 11/1989 Yee
5,105,905 A * 4/1992 Rice ..... H04R 1/345 181/155
5,216,210 A * 6/1993 Kammer ..... H04R 1/2834 181/144
5,502,772 A * 3/1996 Felder ..... H04R 1/20 181/199
5,525,767 A 6/1996 Fields
5,749,433 A 5/1998 Jackson
5,815,589 A 9/1998 Wainwright et al.
5,850,460 A * 12/1998 Tanaka ..... H04R 1/2873 381/182
6,144,752 A * 11/2000 Chen ..... H04R 1/023 181/199
7,418,104 B2 8/2008 Spinale
7,668,331 B2 2/2010 Yen
7,748,495 B2 7/2010 Krueger
7,974,431 B2 7/2011 Saiki
8,045,743 B2 * 10/2011 Aylward ..... H04R 1/028 381/386
8,175,304 B1 * 5/2012 North ..... H04R 5/02 381/17
2006/0078136 A1 * 4/2006 Stiles ..... H04R 1/02 381/182
2007/0030992 A1 * 2/2007 Rauen ..... H04R 1/2873 381/351
2007/0041590 A1 * 2/2007 Tice ..... G08B 7/062 381/77
2008/0130938 A1 * 6/2008 Wan ..... H04R 1/026 381/387
2009/0207607 A1 * 8/2009 Haase ..... F21V 33/0056 362/234
2010/0124345 A1 * 5/2010 Wiech, III ..... H04R 5/02 381/303

OTHER PUBLICATIONS

"Studio Monitor", Wikipedia, http://en.wikipedia.org/wiki/Studio_monitor, Jun. 2, 2015.
"Studio Monitors", B&H Photo, http://www.bhphotovideo.com/explora/audio/tips-and-solution/studio-monitors-nearfields, Staff Writer, Jun. 2, 2015.

* cited by examiner

*Primary Examiner* — Davetta W Goins
*Assistant Examiner* — Oyesola C Ojo
(74) *Attorney, Agent, or Firm* — James G. Passé; Passé Intellectual Property, LLC

(57) ABSTRACT

The present invention is a small high fidelity full spectrum speaker, which arranges a passive speaker and two active speakers such that fidelity of a larger speaker or one with a cross-over network is achieved.

20 Claims, 16 Drawing Sheets

Side View

Top View

LOUDSPEAKER SYSTEM AUDIO RECOVERY IMAGING AMPLIFIER

This application is a continuation-in-part of U.S. non-provisional application Ser. No. 13/430,926 filed on Mar. 27, 2012, and which is incorporated herein in its entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to loudspeakers and systems for the high fidelity reproduction of sound. In particular, the present invention relates to full spectrum loudspeakers designed for close proximity and near field use.

Description of Related Art

Passive radiators (also called passive speakers or passive loudspeakers) are known in audio speaker design. A passive radiator is a radiating diaphragm which is suspended by a compliant suspension component, and whose back surface shares an enclosed air volume with that of an active transducer (speaker or loudspeaker). The movement of the active speaker's diaphragm pressurizing and depressurizing causes the passive speaker to vibrate. The sound produced by the passive speaker adds to the sound produced by the active speaker and increases the overall sound pressure level produced by the entire system.

Audio reproduction incorporates the original designs of active speakers, employing magnets and cone materials to transfer the electronic waves through voice coils, moving the cone material to produce audible sounds the ear can understand. To overcome the back-wave problems inherent with speaker systems, enclosures of all sorts have been developed, with varying formulas and mathematical theories to improve the output of the speakers, i.e. to improve the sound.

A push pull design, where at least two speakers are wired out of phase, was developed and applied in various patents since the 1920's. For example, these patents cover designs wherein the loudspeakers are facing each other, with the same phasing, and also designs with loudspeakers facing opposite directions and out of phase. This allows the two loudspeakers to act as one. Even with the improved response, the remaining need is with low frequency reproduction.

Engineers, inventors, and mathematicians have creatively changed and improved the equations dealing with reproduction of low frequencies, but the paradigm for accomplishing that has not changed. The current technology incorporates large enclosures, or large sized loudspeakers, or a combination of both, to produce the low frequency response required for the current market. In addition, use of crossover circuits and multiple speakers covering different parts of the audible spectrum are utilized. The result is that speaker systems reproducing accurate bass take up a lot of room.

Accordingly, a speaker system which allows for rich full frequency reproduction in a small enclosure is still something the industry is searching for and users would appreciate, especially in situations with small areas for placement of speakers, such as in a small room or inside furniture or light fixtures. Sub woofers are an example of addressing the issue, but subwoofers deal with only the low lows. There are still crossover problems present in this type of speaker system.

BRIEF SUMMARY OF THE INVENTION

The present invention includes the discovery that a full spectrum speaker system with no crossover network circuits and a full bass spectrum can be built with smaller speakers, such as about eight inches or smaller, with the arrangement of speakers of the present invention. While larger speakers can be utilized, the advantage of the speakers being full range and still able to produce full bass sounds is a general improvement over speakers of the prior art. The prior art designs were for boosts of bass frequencies. The present invention takes control of the external drivers by having the internal active driver acting as a piston. This design boasts the whole spectrum of audible sound, with the increased bass response an added benefit. The main result of the piston action is the overall transient response of the driver in all frequencies. The pressure inside the engine, controlled by the piston, on the back of the driver, allows the driver to perform noticeably better, increasing decibel (DB) levels before excursion and increasing response time to changes in the signal. Another benefit is the enhanced performance of the driver at low volumes. The audio image is also projected further into the room than with other speakers, without the addition of large wattage amplifiers.

This design incorporates an audio experience comparable to very high-end and expensive speaker systems. During system development of standard speaker systems using standard design methods the use of subwoofers (electronically cross-linked) is required for low frequency reproduction. The speakers of the present invention avoid the use of subwoofers and crossover networks and, as such, can be designed small and can be installed in smaller objects, such as a piece of furniture, a light fixture, or other near field applications.

This design is a loudspeaker system that reduces the size required for a bass chamber and reduces the air volume requirements for commonly produced audio drivers, resulting in a small audio reproduction enclosure, which produces superior performance in sound pressure levels (SPL) and sound field spatial areas. Because of the reduced size, installation in chairs is not only possible, but desirable. Due to the high fidelity and high quality of sound reproduction, the invention opens up a field of application neither practicable nor previously capable of being exploited before at this level of quality and cost.

The invention includes a solution for mid to low frequency single driver problems by amplifying these frequencies, producing seamless reproduction of introduced electronic signals and further reducing the enclosure size needed. Another embodiment of this disclosure is the amplification of the drivers' characteristics to the point that electronic manipulation of the audio signals is minimized, resulting in accurate and natural sound reproduction. Running a preamp with "flat" tone settings is preferred. By increasing the size of the drivers in the engine, the amplification of the sound-stage image is great enough to compete with existing commercial speaker designs, but maintains relatively small enclosures.

Accordingly, in one embodiment of the invention, there is a full spectrum speaker system for near field applications comprising:

a) a speaker enclosure having an inside and a bottom;

b) a bass chamber located at the bottom inside of the speaker enclosure ported outside the enclosure;

c) a full spectrum baffle mounted passive speaker ported inside the enclosure and positioned directly above and facing the ported bass;

d) a first full spectrum baffle mounted active speaker ported inside the enclosure, positioned directly above the passive speaker and facing downward toward the back of the passive speaker in the same direction as the passive speaker; and e) a second full spectrum baffle mounted active speaker mounted ported outside of the enclosure and in a different direction than the first speaker, the second full spectrum speaker being wired out of phase with the first speaker.

DETAILED DESCRIPTION OF THE INVENTION

Figure 1:
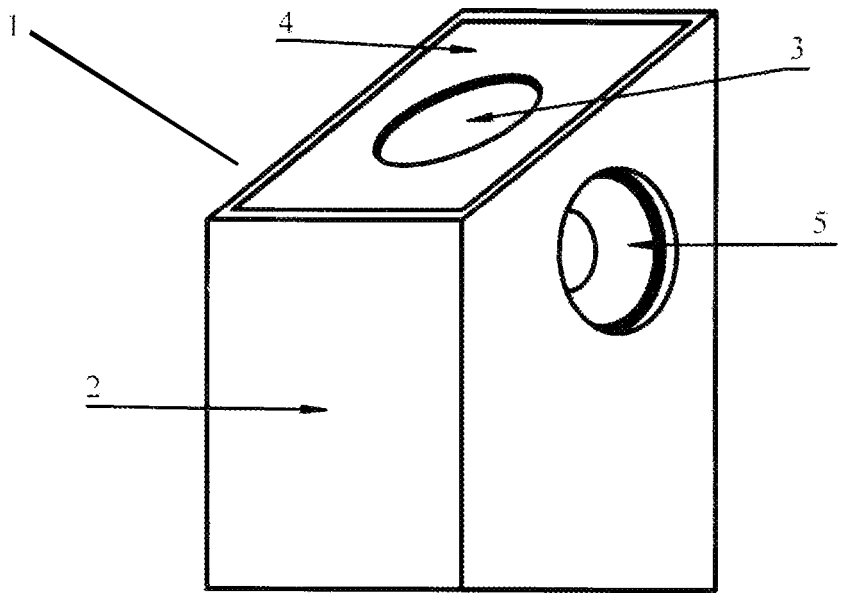
FIG. 1 is an external perspective view of a speaker system of the present invention.

While this invention is susceptible to embodiment in many different forms, there is shown in the drawings, and will herein be described in detail, specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

DEFINITIONS

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

References throughout this document to "one embodiment", "certain embodiments", and "an embodiment" or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are for the purpose of illustrating certain convenient embodiments of the present invention, and are not to be considered as limitations thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the phrase "full spectrum speaker" refers to a driver which reproduces as much of the audible frequency range as possible. The frequency range of these drives is maximized through the use of a whizzer cone and other means other than electronic crossovers. Typically, that range is considered to be greater than about 40 Hz in the audible range, typically up to about 20,000 Hz.

As used herein, the phrase "crossover network" refers to an electronic device that delivers a limited portion of the audible spectrum to a given speaker by installing the crossover between the audio source and the given speaker. In the present invention, the entire spectrum is delivered to speakers without use of crossovers.

The use of full range drivers has eliminated the need for electronic crossovers. Individual drivers inherently possess distinct characteristics; so many different commonly available makes of drivers have been tested. We have discovered that this design works on all different size drivers. Increasing the size of the driver introduces even more advantages in SPL levels and amplification of the sound stage and resulting image. Another advantage in sound quality is combining different sized (due to driver size) completed engines. The results are a combination of the qualities of each engine, with additions in spectrum reproduction instead of subtractions in frequencies that often occur with phasing issues encountered with placing drivers in close proximity.

As used herein the phrase "speaker enclosure" refers to an enclosure designed for speaker use that is sealed except for the bass port. The enclosure can be made of any suitable material such as wood, composites, or any material used for speaker enclosures known in the art. The housing can be relatively any size, but in one embodiment it is less than about 600 sq. inches and, in another embodiment, about 500 to 510 sq. inches in volume. The specific dimensions depend on the particular use, as shown in the figures. So, where used in a chair arm, or similarly in a light fixture or other utility, a particular shape can be fitted. Such a shape is within the skill of the art in view of this disclosure. The enclosure can include insulation or other acoustic materials normally utilized in a speaker enclosure, as known in the art. The minimum requirements are, of course, to enable the speaker arrangement of the present invention to be accommodated. In one embodiment, the enclosure is as small as possible to accommodate the speaker arrangement as claimed herein. In another embodiment, there are multiple speaker systems combined, one speaker for each channel of an audio system.

As used herein, the phrase "bass chamber" refers to a chamber ported to the outside of the speaker enclosure that produces lower frequencies due to the sound waves coming from active or passive speakers in the enclosure. The chamber is located in the bottom of the enclosure with the port to the outside. The top of the sealed chamber (sealed except for the port) is made of wood or other acoustic material and produces low frequencies due to both the active and passive speakers whose diaphragms are pointed at the top. The size of the bass chamber is, in one embodiment, from about 80 sq. inches to 85 sq. inches and can be determined by using the formula "width×depth(of enclosure)×½ diameter of passive internal speakers". One of the advantages of this chamber is the production of bass frequencies normally produced by larger woofer type speakers.

As used herein, the phrase "active speaker" refers to a speaker electrically connected to a powered audio source to produce an audio sound.

As used herein, the phrase "passive speaker" refers to a speaker with a radiating diaphragm, which is suspended by a compliant suspension component, and whose back surface shares an enclosed air volume with that of an active speaker (loudspeaker).

As used herein, the term "baffle" refers to a board or the like (internal or on the exterior of the enclosure) that the speaker is mounted to as a method of dampening standing waves. The placement of the baffles is described in the drawings and associated with the at least three speakers of the present invention i.e. the active and passive downward facing speaker and the outward facing speaker.

As used herein the term "cylinders" refers to cylinders positioned inside the enclosure (or a portion of the enclosure itself as shown in the drawings) made of acoustically dead material they can be positioned where they will improve the acoustic sound but, in one embodiment, one separates the active speakers. They can be positioned as shown in the figures as well.

As used herein, the term "furniture" refers to a chair, a couch, or the like in which a speaker enclosure is placed. Applying cylinders around the passive speaker to capture the low frequencies was done for a dual purpose, relating to furniture installation. The first concern was containing the lows. The second part of the goal was directing as much of the lows into the seat containing the listener as possible, while fulfilling the first concern of keeping as much of the lows from the surrounding environment as possible. This applies when dealing with multiple chairs in the same room. Working with the bass chamber by completely sealing the cavity except for a port, and tuning the port correctly, this produced extraordinary bass in a small enclosure, with some directional control, suitable for installation into furniture; no sub-woofer required.

As used herein, the phrase "lighting fixture" refers to a ceiling fixture such as used for spot lighting or other ceiling type fixture capable of installation of the speaker of the present invention. Also refers to sconces, free standing lamps, and table lamps.

As used herein, the phrase "small chamber" refers to the speaker enclosure being of a relatively small size, for example between about 180" cubed and 190" cubed. To maintain the smallest enclosure possible, the present invention throws out the assumptions of the current paradigm, especially dealing with air volumes and back waves. The present design compresses the air into a sealed static enclosure by having the internal driver fire directly into the passive radiator. The characteristics of the passive radiator limit the mid to high frequencies from being reproduced into the environment, thus minimizing upper frequency issues between the internal and air ported first driver. Thus the engine controls over-excursion on the first driver by equalizing the back waves and their load on the driver, virtually eliminating the changing loads resulting from open air. The result is more SPL's from both drivers without damage to the mechanical properties of the drivers. Due to the smallness of the bass chamber, the need to compensate for refracted and reflected back waves is minimized. The result is a pure and natural bass reproduction far superior to other designs. Commonly accepted mathematical equations for air volume and enclosure shape for low frequency response do not work for small enclosures, so we reduced volumes to minimal amounts, with more concern for overall size. This concept is used for single drivers, but usually coupled with separate enclosures for mid to low bass needed for full spectrum reproduction. This invention includes full spectrum reproduction in one small enclosure.

The overall result of this invention includes an elongated sound stage on all three axis, x, y, and especially z, with superior full range frequency response, in a small enclosure. This makes the installation into furniture possible without sacrificing any frequency response and creating a new audio experience we call close proximity. However, our research shows that the benefits of this engine can be enjoyed in near field installations just as well when driver size is varied.

Now, referring to the drawings: FIG. 1 is a perspective view of an enclosure of the present invention. Speaker system 1 comprises an enclosure 2. In baffle 4 tiled about 30 degrees off axis is mounted active speaker 3. Passive speaker 5 is outward facing in a side of the speaker enclosure 2.

Figure 2:
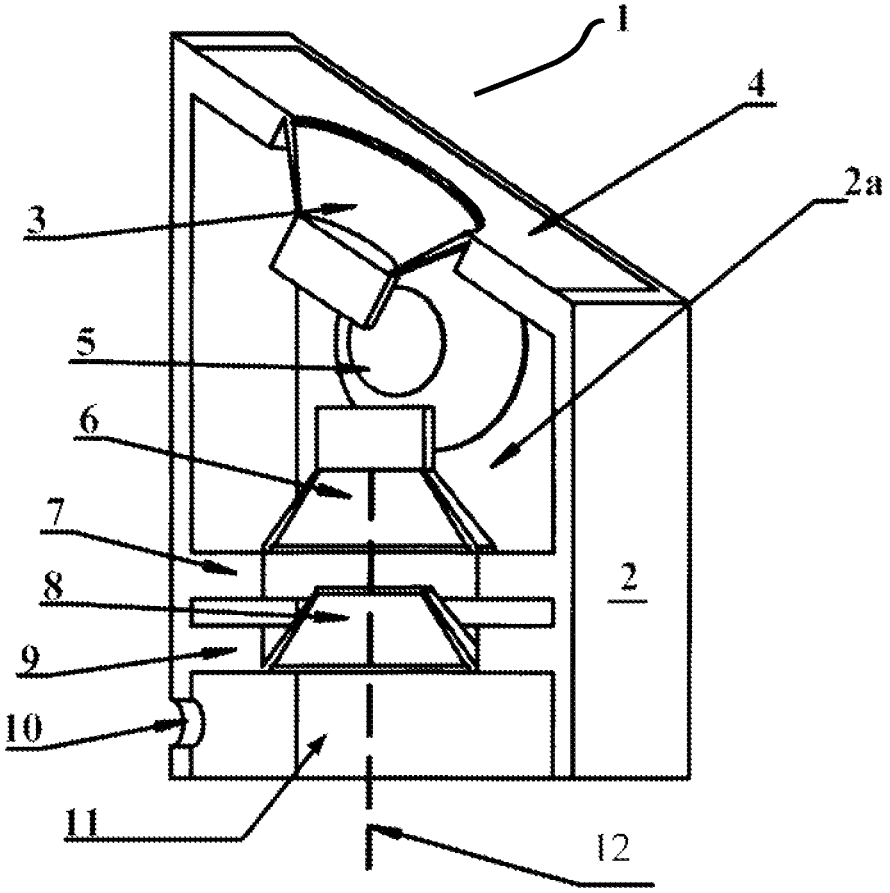
FIG. 2 is a perspective cutaway view of the speaker system of FIG. 1.

FIG. 2 is a cutaway of the enclosure of FIG. 1. In this view we can see active speaker 6 which is facing downward and mounted on a baffle 7 inside speaker enclosure 2*a*. Below speaker 6 is passive speaker 8 which shares an axis 12 with speaker 6 and is mounted on baffle 9. Lastly at the bottom of enclosure 2 is bass chamber 11 with port 10 to the outside of speaker 2. In this view port 10 is positioned to the rear of the speaker but which side the port is on is not a critical position.

Figure 3:
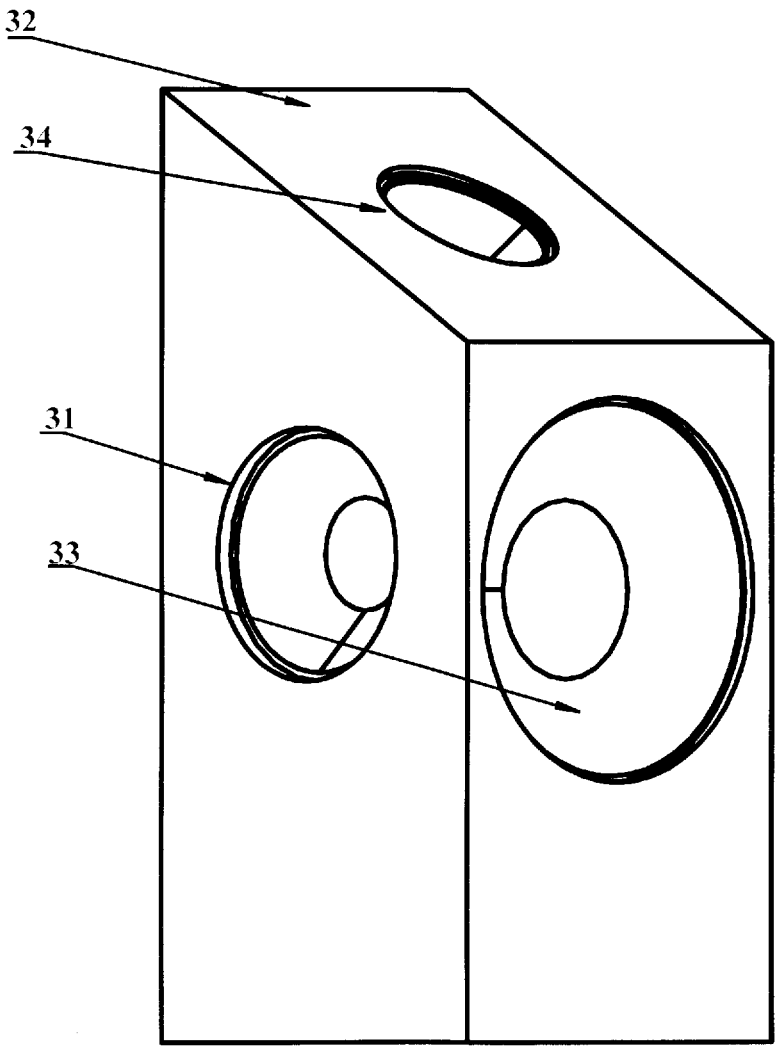
FIG. 3 is a perspective view of external ported speakers, two active, one passive.
Figure 4:
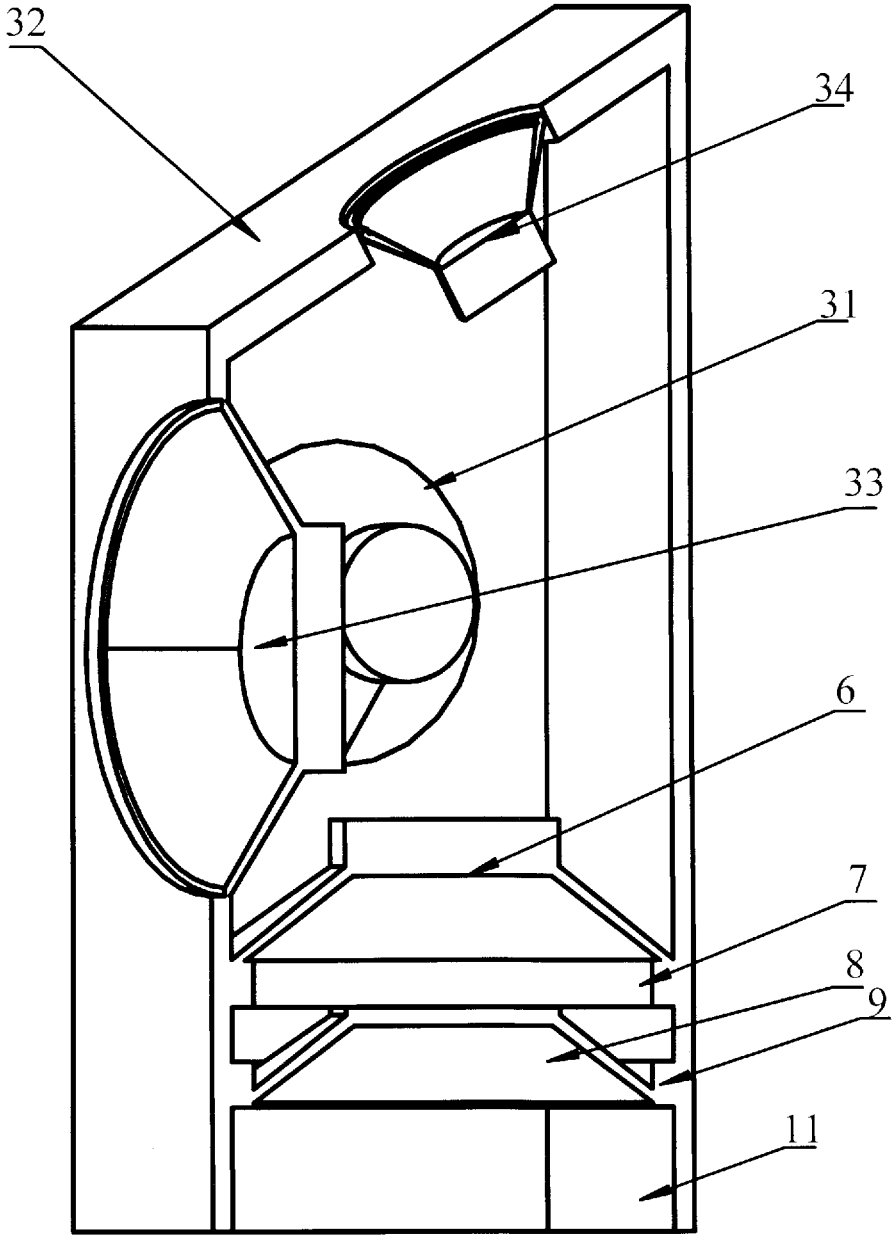
FIG. 4 is a perspective cutaway view of the speaker system of FIG. 3.

FIG. 3 is a perspective view of an external ported speaker with two active and one passive speaker facing outward. Speaker cabinet 32 comprises captive mounted speakers 33 and 34 with passive speaker 31. The cutaway view of this speaker is shown in FIG. 4

Figure 5:
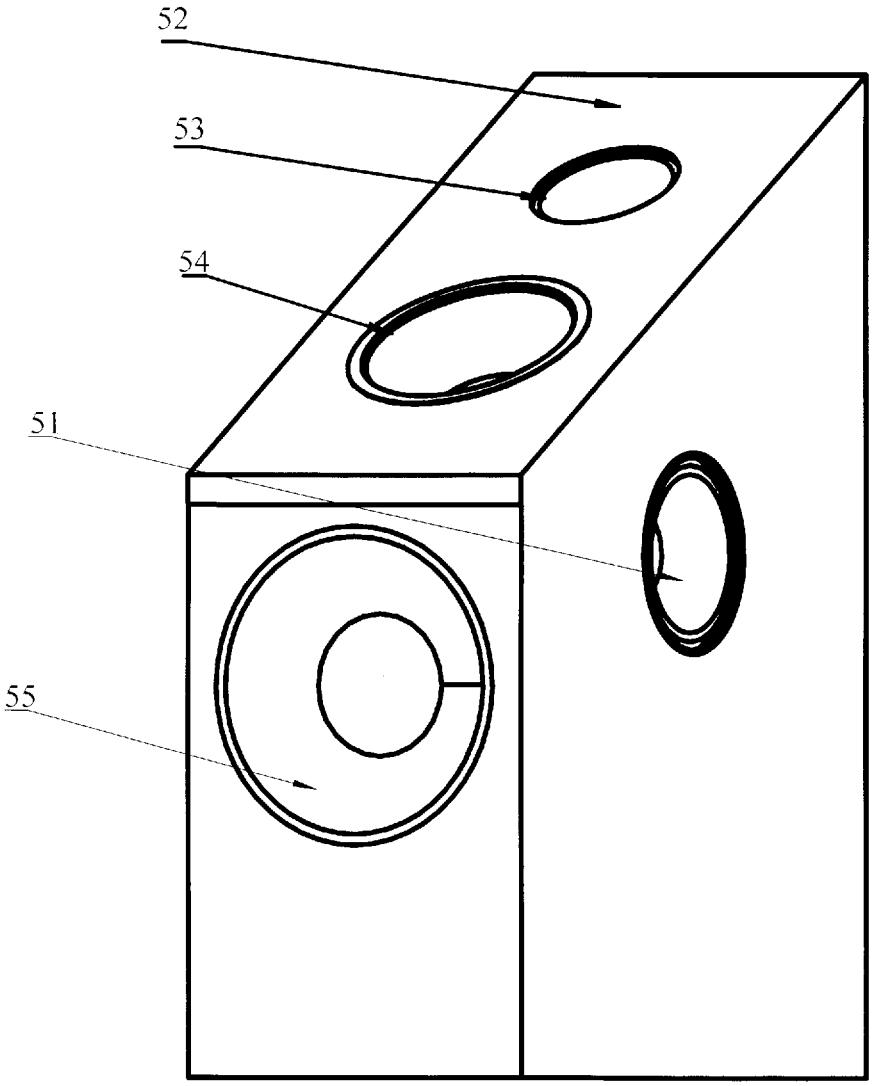
FIG. 5 is a perspective view of an external ported speaker system with three active and one passive.
Figure 6:
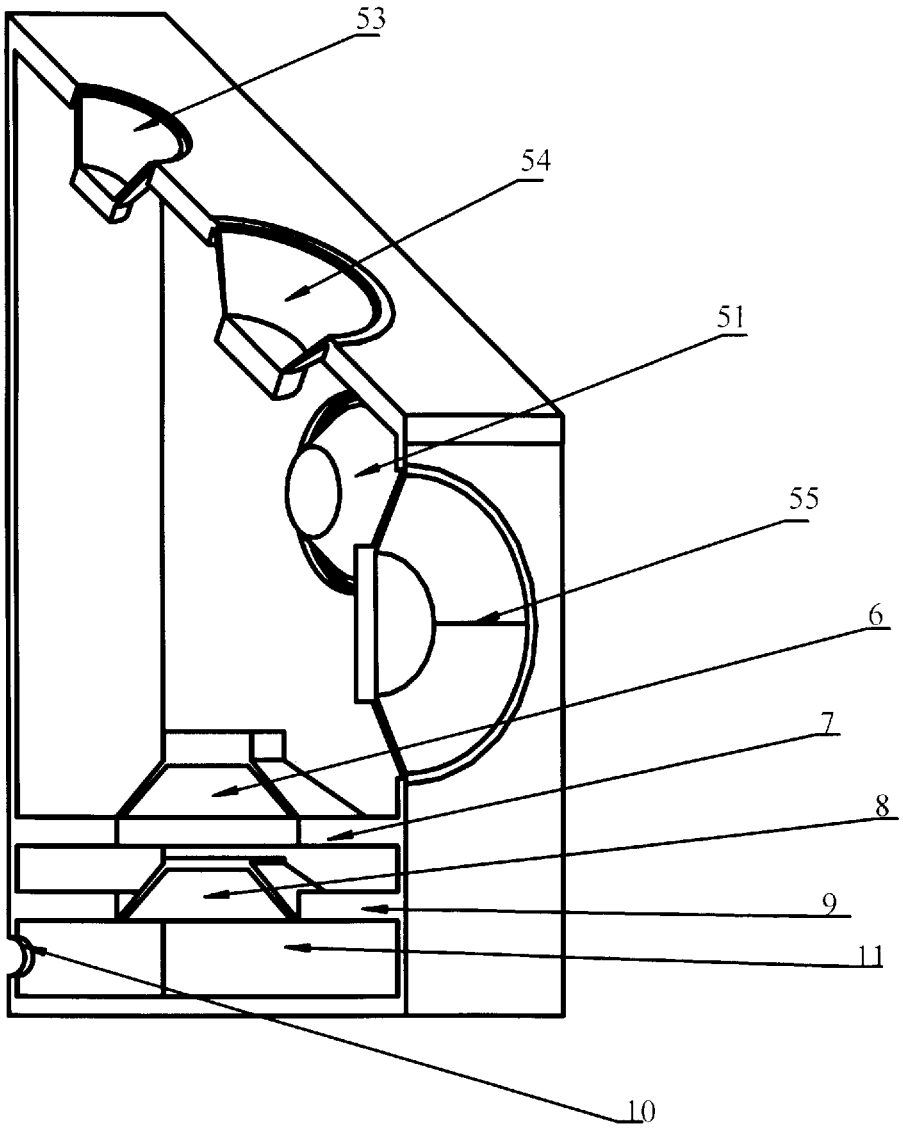
FIG. 6 is a cutaway perspective view of the system of FIG. 5.

FIG. 5 is a perspective view of an external ported speaker system with three active and one passive loudspeaker. FIG. 6 is a cutaway view of this speaker system 52 has active loudspeakers 53, 54 and 55 and one passive loudspeaker 51.

Figure 7:
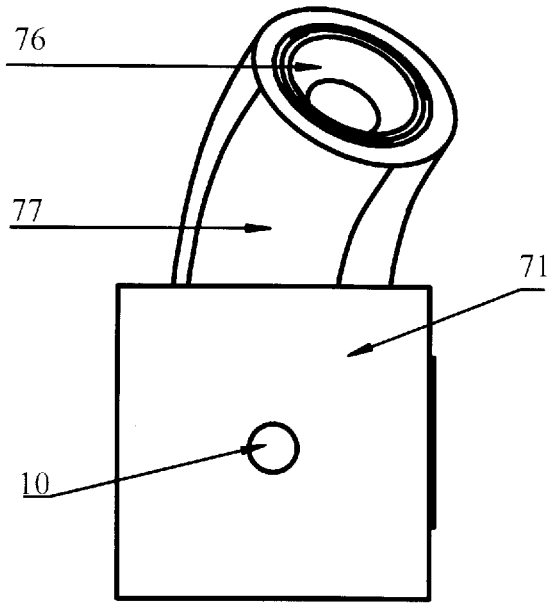
FIG. 7 is an external perspective view of a speaker system designed (shaped) to fit in the arm of a piece of furniture, such as a chair.
Figure 8:
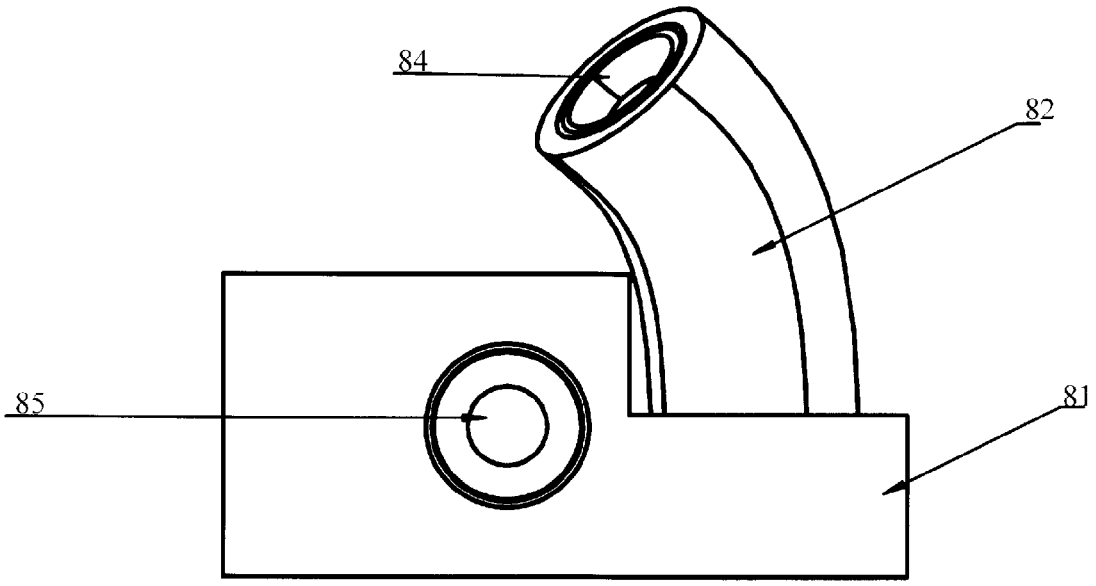
FIG. 8 is an external side perspective view of a speaker system of FIG. 7 with an additional passive speaker.
Figure 9:
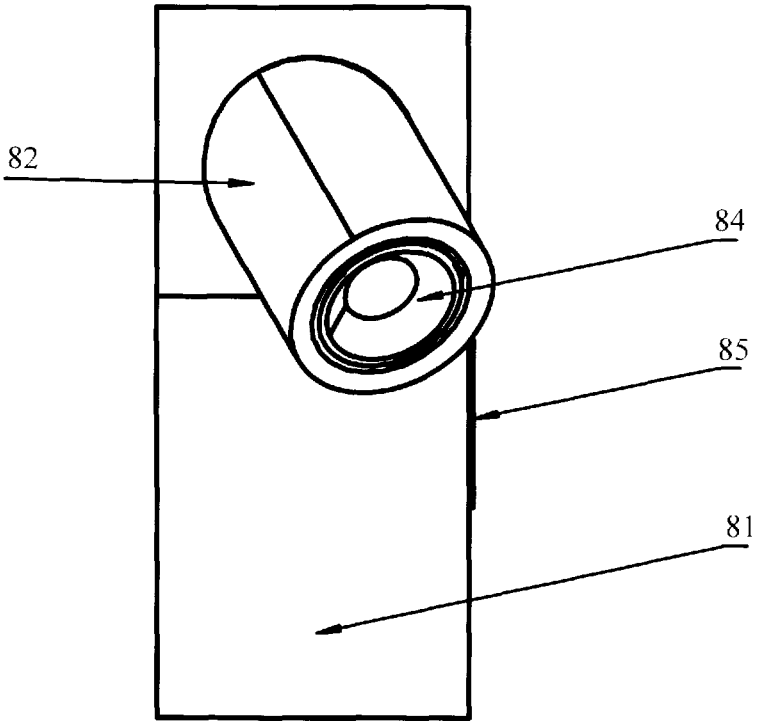
FIG. 9 is a top view of the speaker of FIG. 8.
Figure 10:
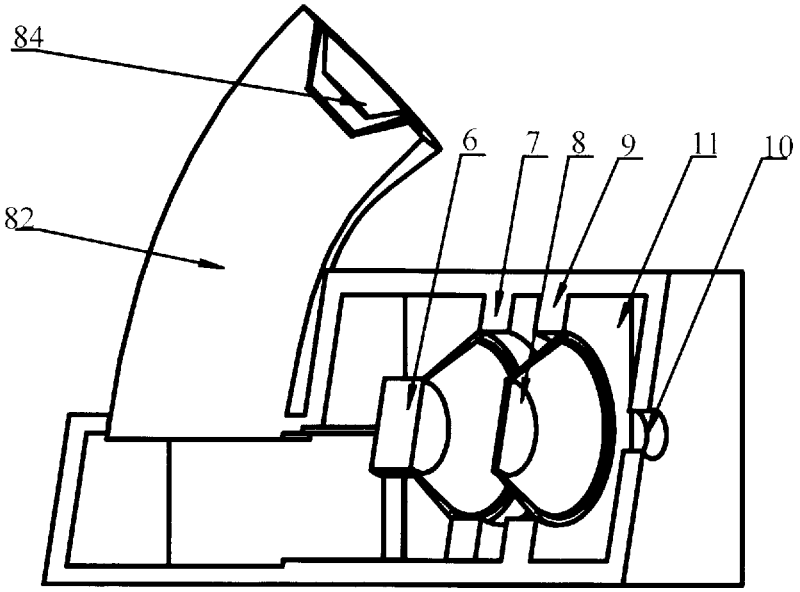
FIG. 10 is a perspective cutaway view of a furniture speaker arrangement.

FIG. 7 is an external perspective view of a speaker system designed/shaped to fit in the arm of a piece of furniture such as a chair. Speaker system 71 has cylinder 77 enclosing active speaker 76. FIG. 8 is another external perspective of a speaker system like in FIG. 7 with an addition external facing active speaker. Speaker system 81 has cylinder 82 and active speaker 84. Additionally, active speaker 85 is shown in the side of speaker system 81. FIG. 9 is a top view of the speaker system in FIG. 8. FIG. 10 is a cutaway of the same speaker system.

Figure 11:
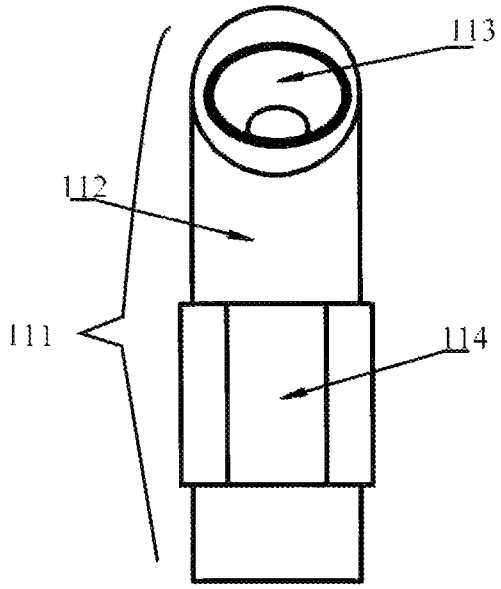
FIG. 11 is a sealed bass chamber (no port shown).

FIG. 11 is a view of a speaker system with a sealed (ported, but on back, can be seen in cutout as in FIG. 10) bass chamber. Speaker system 111 has cylinder 112 with speaker 113 and non-ported bass chamber 114. The enclosure is round, otherwise it is the same as the other enclosures in the figures.

Figure 12:
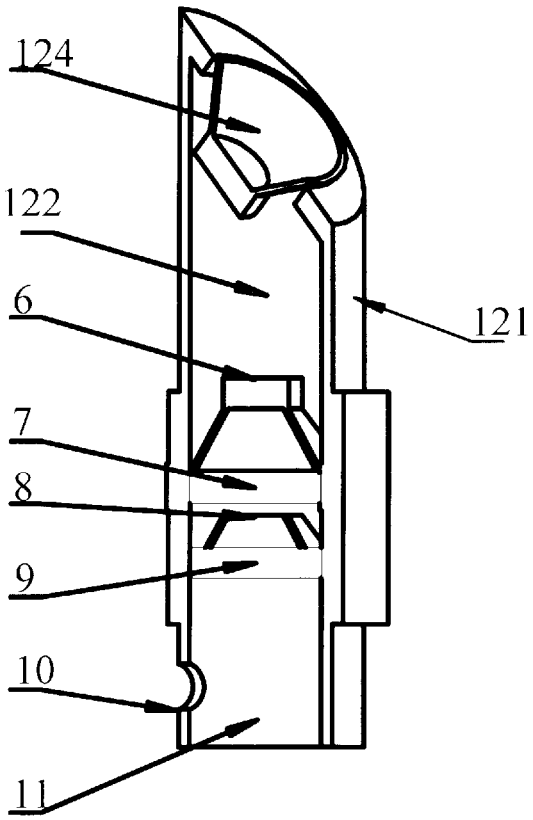
FIG. 12 is a perspective cutaway view of a speaker designed to fit into a lighting fixture.

FIG. 12 is a cutaway view of a speaker system designed to fit in a lighting fixture. Speaker system 121 is a cylinder 122 and in this view is fitted with external facing active speaker 124.

Figure 13:
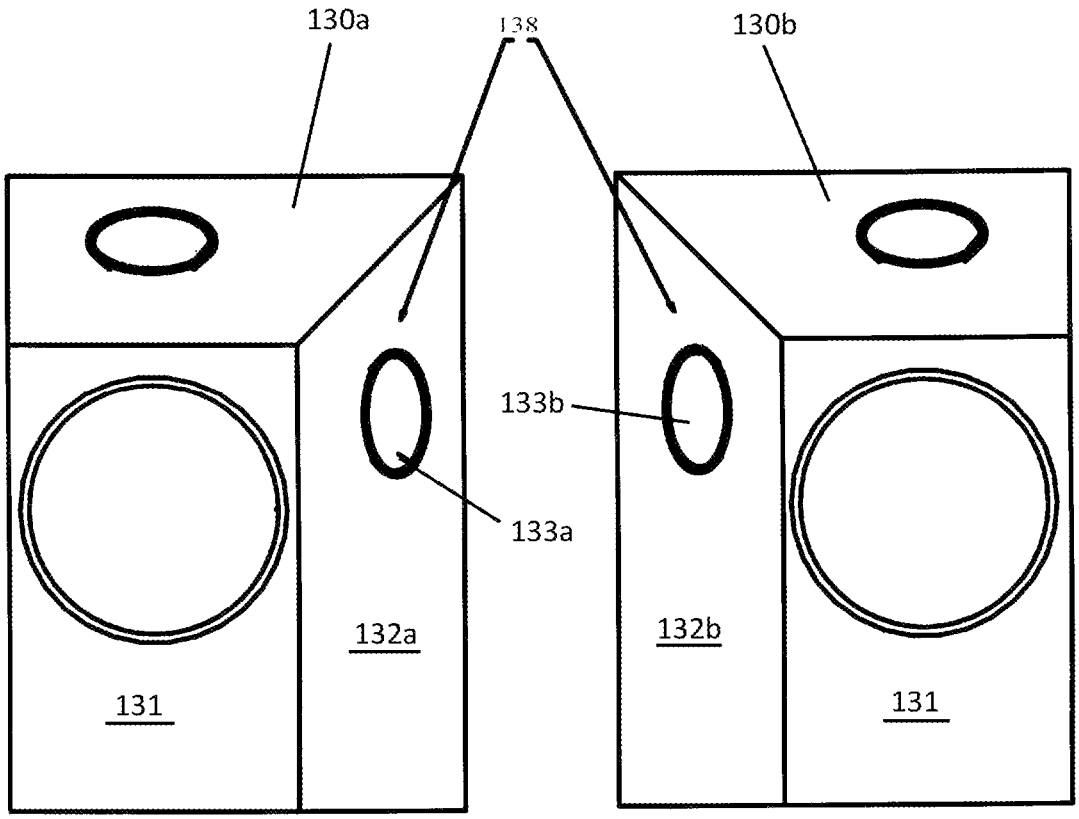
FIG. 13 is a pair of enclosures showing 30 degrees perpendicular to the front baffle on facing side baffles.

FIG. 13 is a pair of enclosures showing 30 degree rotation on facing side baffles 138. In this view, speakers 130*a* and 130*b* have a front face 131, side baffles 132*a* and 132*b*, and are 30 degrees on both of the planes perpendicular to front faces 131*a* and 131*b* respectively. Front faces 131 are positioned during use on the same plane such that active speakers 133*a* and 133*b* face each other, as shown. This embodiment increases predicted information over perpendicular face side baffles.

Figure 14:
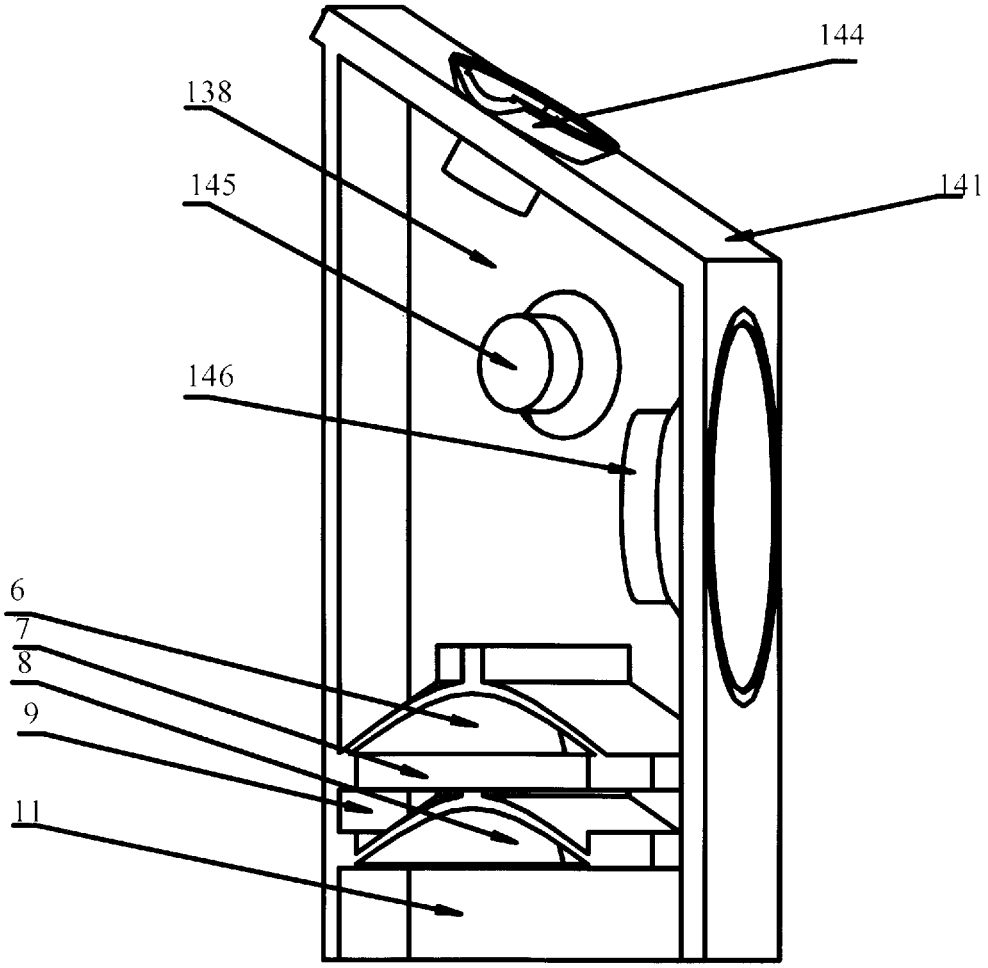
FIG. 14 is a cutaway perspective of a speaker system with three outside ported active speakers and no passive outside ported speaker.

FIG. 14 is a cutaway view of one of the speaker systems of FIG. 13 showing three outside ported active speakers and no passive outside ported speaker. Speaker system 141 consists of active speakers ported outwardly 144, 145 and 146.

Figure 15:
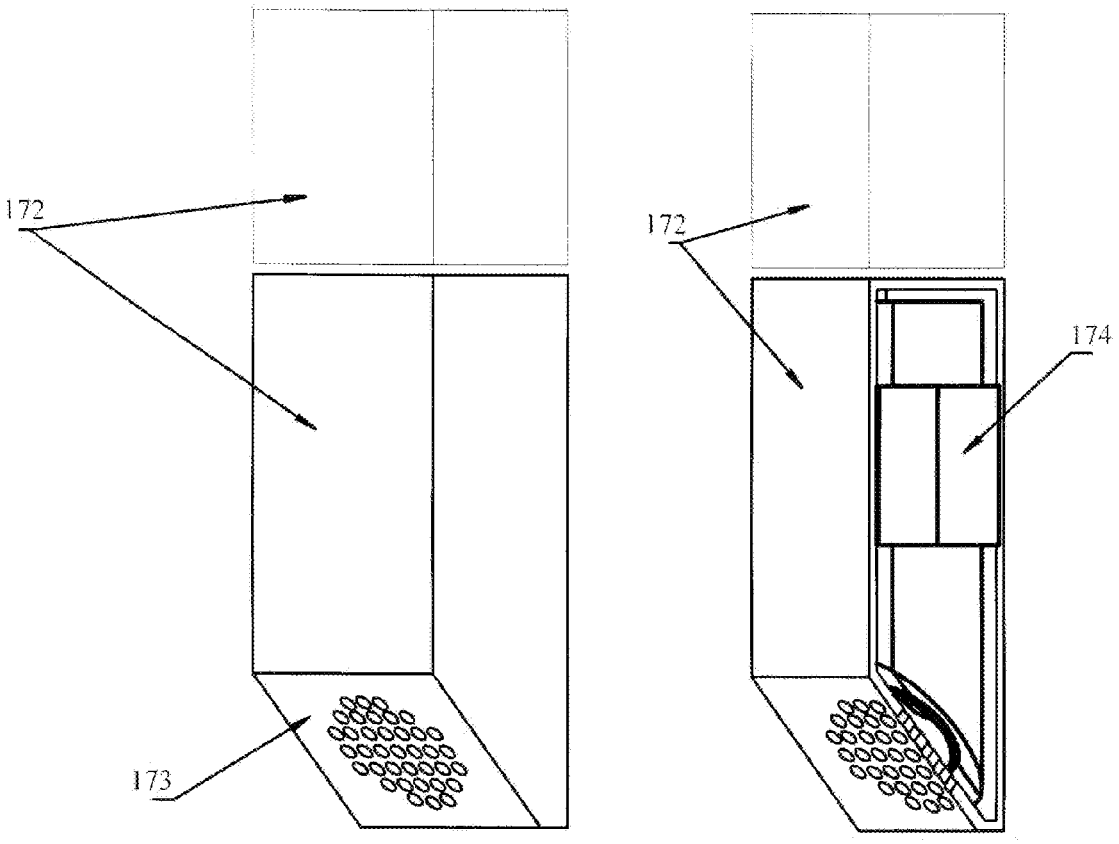
FIG. 15 is a perspective of a piece of furniture with a speaker system of the present invention mounted therein.

FIG. 15 is a speaker system of the present invention in cutaway view showing a speaker system mounted inside a lighting fixture. Light fixture 172 has speaker system 174 mounted inside with only active speaker 173 showing.

Figure 16:
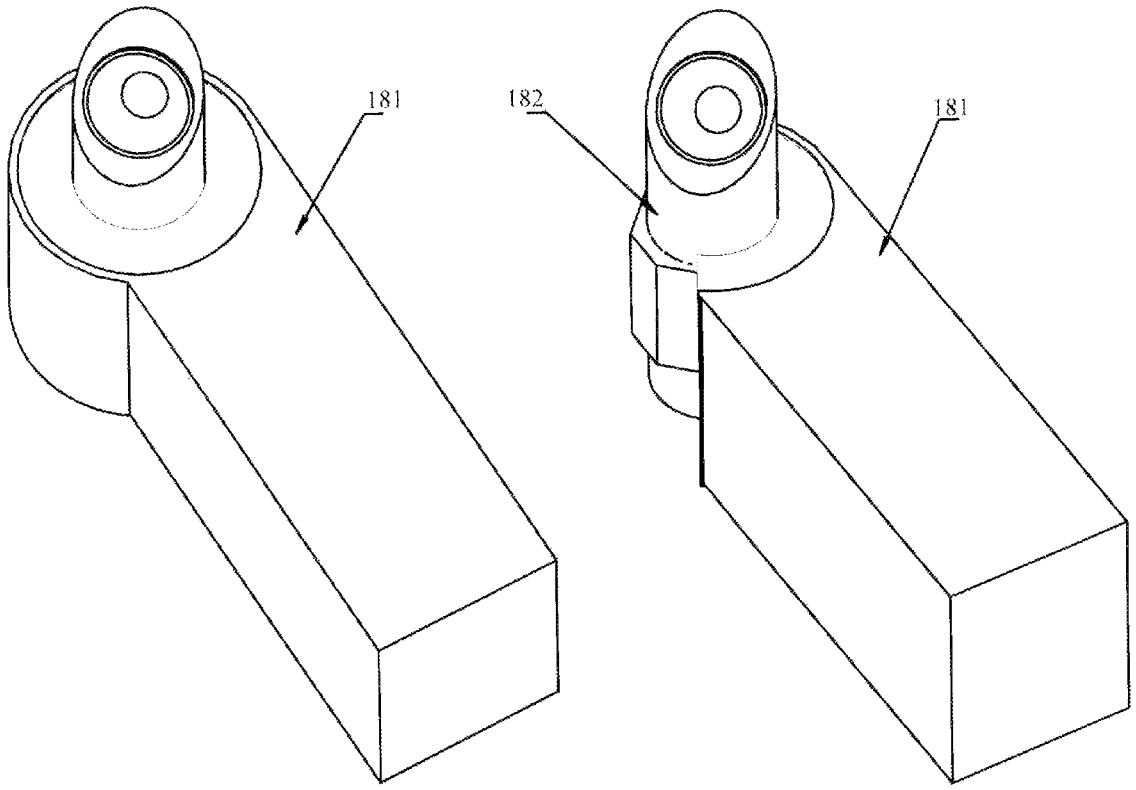
FIG. 16 is a speaker system of the present invention mounted inside a ceiling lighting fixture.

FIG. 16 is a perspective of a piece of furniture with a speaker system of the present invention mounted therein in a chair which has arm 181. Mounted therein is speaker 182 of a style similar to FIG. 10, the interval parts are not shown.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials and the like apparent to those skilled in the art still fall within the scope of the invention as claimed by the applicant.

What is claimed is:

1. A full spectrum speaker system without use of crossover networks comprising:

a) a speaker enclosure having an inside and an inside bottom;

b) a bass chamber located across the inside bottom of the speaker enclosure ported outside the enclosure having a baffle positioned horizontally above the speaker enclosure bottom forming a bass chamber top;

c) a full spectrum baffle mounted passive speaker ported inside the enclosure and positioned facing the enclosure bottom directly above and facing the ported bass baffle;

d) a first full spectrum baffle mounted active speaker ported inside the enclosure, positioned directly above the passive speaker and facing downward toward the back of the passive speaker in the same direction as the passive speaker; and e) a second full spectrum baffle mounted active speaker mounted ported outside of the enclosure and facing in a different direction than the first speaker, the second full spectrum active speaker being wired out of phase with the first full spectrum active speaker.

2. The speaker system according to claim 1 which further comprises at least two tubular cylinders positioned inside the enclosure.

3. The speaker system according to claim 2 which comprises a first tubular cylinder positioned inside the enclosure separating the first speaker and the second speaker.

4. The speaker system according to claim 2 which comprises a second tubular cylinder separating the passive speaker and the first speaker.

5. The speaker system according to claim 1 wherein a diaphragm of the first speaker and the passive speaker are aligned along the axis of their diaphragm.

6. The speaker system according to claim 1 wherein the second speaker is positioned about 135 degrees different than the position of the first speaker.

7. The speaker system according to claim 1 which further comprises at least one full spectrum baffle mounted passive speaker ported outside the enclosure.

8. The speaker system according to claim 1 which further comprises at least one additional full spectrum speaker ported outside the enclosure.

9. The speaker system according to claim 8 wherein there are two to three additional full spectrum speakers ported outside the enclosure.

10. The speaker system according to claim 1 wherein the system is constructed for near field applications.

11. The speaker system according to claim 1 wherein the internal passive speaker is ported onto the bass chamber.

12. The speaker system according to claim 1 wherein the bass chamber is from about 80 sq. inches to about 85 sq. inches.

13. The speaker system according to claim 1 wherein the speaker system is installed in a piece of furniture.

14. The speaker system according to claim 13 wherein the speaker system is mounted inside of a chair.

15. The speaker system according to claim 1 wherein the speakers of the speaker system are from about three inches to about eight inches in diameter.

16. The speaker system according to claim 1 wherein the enclosure is from about 500 sq. inches to about 510 sq. inches.

17. The speaker system according to claim 1 wherein the speaker system is installed in a lighting fixture.

18. The speaker system according to claim 1 wherein there are a plurality of speaker systems.

19. The speaker system according to claim 18 wherein there are two speakers systems, each with one side baffle 30 degrees off of perpendicular to a front face of each speaker, each such side baffle having an active speaker mounted therein facing outward, and wherein one speaker has a left baffle 30 degrees off perpendicular and the other speaker a right baffle 30 degrees off perpendicular.

20. A full spectrum speaker system without use of cross-over networks comprising:

a) a speaker enclosure having an inside and an inside bottom;

b) a full spectrum baffle mounted passive speaker ported inside the enclosure and positioned facing the enclosure inside bottom;

c) a first full spectrum baffle mounted active speaker ported inside the enclosure, positioned directly above the passive speaker and facing downward toward the back of the passive speaker in the same direction as the passive speaker; and d) a second full spectrum baffle mounted active speaker mounted ported outside of the enclosure and facing in a different direction than the first speaker, the second full spectrum active speaker being wired out of phase with the first full spectrum active speaker.

* * * * *